US008849654B2

(12) United States Patent
Li et al.

(10) Patent No.: US 8,849,654 B2
(45) Date of Patent: Sep. 30, 2014

(54) METHOD, DEVICE AND SYSTEM FOR VOICE ENCODING/DECODING

(75) Inventors: Xiaoshuang Li, Shenzhen (CN); Xingguo Gao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/464,872

(22) Filed: May 4, 2012

(65) Prior Publication Data

US 2012/0221327 A1 Aug. 30, 2012

Related U.S. Application Data

(63) Continuation of application No. PCT/CN2009/075476, filed on Dec. 10, 2009.

(51) Int. Cl.
*G10L 21/00* (2013.01)
*G10L 19/00* (2013.01)
*G10L 21/0208* (2013.01)

(52) U.S. Cl.
CPC ..... *G10L 19/00* (2013.01); *G10L 2021/02082* (2013.01)
USPC ..... 704/211; 704/500; 704/501; 704/502; 704/503; 704/504

(58) Field of Classification Search
USPC ..... 704/211, 500–504
See application file for complete search history.

(56) References Cited

U.S. PATENT DOCUMENTS

| | | | | |
|---|---|---|---|---|
| 6,594,359 | B1 | 7/2003 | Park | |
| 7,035,282 | B1 | 4/2006 | Jagadeesan et al. | |
| 2002/0064139 | A1 * | 5/2002 | Bist et al. | 370/289 |
| 2002/0076034 | A1 * | 6/2002 | Prabhu et al. | 379/390.02 |
| 2002/0116186 | A1 * | 8/2002 | Strauss et al. | 704/233 |
| 2004/0090949 | A1 | 5/2004 | So et al. | |
| 2008/0037618 | A1 | 2/2008 | LeBlanc et al. | |
| 2008/0175233 | A1 * | 7/2008 | Chung et al. | 370/356 |
| 2008/0287063 | A1 | 11/2008 | Kidron et al. | |
| 2009/0059905 | A1 | 3/2009 | Barzegar et al. | |
| 2009/0207837 | A1 * | 8/2009 | Mielich | 370/353 |

FOREIGN PATENT DOCUMENTS

| | | | |
|---|---|---|---|
| CN | 1122397 | C | 9/2003 |
| CN | 100456358 | C | 1/2009 |
| EP | 0 969 689 | B1 | 7/2002 |
| EP | 1748590 | A1 | 1/2007 |
| EP | 2111036 | A2 | 10/2009 |

OTHER PUBLICATIONS

Written Opinion of the International Searching Authority dated Sep. 16, 2010 in connection with International Patent Application No. PCT/CN2009/075476, 5 pages.
Extended European Search Report dated Dec. 4, 2012 in connection with European Patent Application No. 09851973.9, 5 pages.
Heping Ding; "Wideband Audio Over Narrowband Low-Resolution Media" Institute for Microstructural Sciences, National Research Council, Canada, May 17-21, 2004, 4 pages.
International Search Report dated Sep. 16, 2010 in connection with International Patent Application No. PCT/CN2009/075476.
Partial translation of Office Action dated Jan. 28, 2013 in connection with Chinese Patent Application No. 200980148063.9.

* cited by examiner

*Primary Examiner* — Leonard Saint Cyr

(57) ABSTRACT

A method, a device and a system for voice encoding/decoding are disclosed in the present invention. The method includes: assembling an input pulse code modulation signal into one signal according to a designated time slot and assembly manner; and encoding the assembled signal according to a designated encoding manner to output an encoded voice signal. In the present invention, because a process of assembling or splitting the signal may be implemented through software, in the case that hardware in a current network does not need to be replaced, an effect of encoding/decoding voice with a 7 K spectrum may be achieved in the current network.

4 Claims, 5 Drawing Sheets

METHOD, DEVICE AND SYSTEM FOR VOICE ENCODING/DECODING

CROSS-REFERENCE TO RELATED APPLICATIONS

This application is a continuation of International Application No. PCT/CN2009/075476, filed on Dec. 10, 2009, which is hereby incorporated by reference in its entirety.

TECHNICAL FIELD

The present invention relates to communications technologies, and in particular, to a method, a device and a system for voice encoding/decoding.

BACKGROUND

In a conventional PSTN (Public Switched Telephone Network, public switched telephone network) network, a 64 K bandwidth is generally provided, where a 3.4 K spectrum is used for transmitting a voice signal. Because a spectrum of people speaking may generally reach 7 K, distortion usually occurs in voice with a 3.4 K spectrum provided in the conventional PSTN network, which is also the reason why voice of people on the telephone is different from that in a practical environment. Compared with the conventional PSTN network, because an audio signal with a frequency reaching 7 K may be processed in a G.722 encoding/decoding manner, in order to solve a voice distortion problem, in an IP (Internet Protocol, Internet protocol) network, a voice solution based on the G.722 encoding/decoding manner is provided by many chip manufacturers.

As shown in FIG. 1, two parts of hardware are required to implement voice encoding/decoding that is based on G.722 in the prior art. One part is a POTS (Plain Old Telephone Service, plain old telephone service) subscriber board, and the subscriber board includes a Codec (codec)/SLIC (Subscriber Line Interface Circuit, subscriber line interface circuit); and the other part is a DSP (Digital Signal Processing, digital signal processing) chip. In a specific process of voice encoding, the DSP chip multiplies frequencies of two 8 K PCM (Pulse Code Modulation, pulse code modulation) signals into 16 K, and 16-K sampling is implemented through two time slots. In addition, a 16-K based processing mode is also used inside the DSP chip. The PCM signal with two time slots is restored to 16-K data, and then EC (echo cancel, echo cancel)/Tone Detect (tone detect) and encoding are performed on the 16-K data, and finally, an encoded signal is output in an RTP (Real-time Transport Protocol, real-time transport protocol) format. A voice decoding process is a reverse process of the voice encoding.

Since voice with a 7 K spectrum is not widely applied at present, and a current network mainly adopts the voice with the 3.4 K spectrum, the DSP chip applied in the current network generally does not support 16-K frequency multiplication and 16-K code stream processing, that is, products widely used in the current network cannot provide a function of encoding/decoding voice with a 7 K spectrum. The 16-K frequency multiplication needs to be supported by hardware inside the DSP chip. If a voice encoding/decoding implementation solution provided in the prior art is expected to be supported, the hardware inside the DSP chip in the current network needs to be replaced.

SUMMARY

In the case that hardware in a current network does not need to be replaced, in order to implement a function of encoding/decoding voice with a 7 K spectrum in the current network to lower a requirement imposed by voice encoding/decoding on the hardware, embodiments of the present invention provide a method, a device and a system for voice encoding/decoding. The technical solutions are as follows.

In an aspect, a voice encoding method is provided. The method includes:

performing echo cancel and tone detect on an input pulse code modulation signal to output first signals;

assembling the first signals into a second signal according to a designated time slot and assembly manner; and encoding the second signal according to a designated encoding manner to output a voice signal.

In another aspect, a communication device is provided. The device includes:

a processing module, configured to perform echo cancel and tone detect on an input pulse code modulation signal to output first signals;

an assembling module, configured to assemble the first signals into a second signal according to a designated time slot and assembly manner; and an encoding module, configured to encode the second signal according to a designated encoding manner to output a voice signal.

A voice decoding method is further provided. The method includes:

decoding an input voice signal to output a second signal;

splitting the second signal into at least two first signals; and performing echo cancel and tone detect on the first signals to output a pulse code modulation signal.

A communication device is further provided. The device includes:

a decoding module, configured to decode an input voice signal to obtain a second signal;

a splitting module, configured to split the second signal into at least two first signals; and a processing module, configured to perform echo cancel and tone detect on the first signals to output a pulse code modulation signal.

An embodiment of the present invention further provides a communication system. The system includes a communication device.

The communication device includes:

a processing module, configured to perform echo cancel and tone detect on an input pulse code modulation signal to output first signals;

an assembling module, configured to assemble the first signals into a second signal according to a designated time slot and assembly manner; and an encoding module, configured to encode the second signal according to a designated encoding manner to output a voice signal.

An embodiment of the present invention further provides a communication system. The system includes a communication device.

The communication device includes:

a decoding module, configured to decode an input voice signal to obtain a second signal;

a splitting module, configured to split the second signal into at least two first signals; and a processing module, configured to perform echo cancel and tone detect on the first signals to output a pulse code modulation signal.

The technical solutions provided in the embodiments of the present invention have the following beneficial effects.

A pulse code modulation signal is assembled before encoding, and then an assembled signal is encoded to output a voice signal. When the voice signal is input, the voice signal is decoded and split to realize that the pulse code modulation signal is output. Because a process of assembling or splitting the signal may be implemented through software, through the technical solutions provided in the embodiments of the present invention, in the case that the hardware in the current network does not need to be replaced, the function of encoding/decoding voice with a 7 K spectrum in the current network may also be implemented, thus lowering the requirement imposed by the voice encoding/decoding on the hardware.

BRIEF DESCRIPTION OF THE DRAWINGS

To describe the technical solutions in the embodiments of the present invention more clearly, the accompanying drawings required for describing the embodiments are introduced briefly in the following. Apparently, the accompanying drawings in the following description are only some embodiments of the present invention, and persons of ordinary skill in the art may also derive other drawings according to these accompanying drawings without creative efforts.

DETAILED DESCRIPTION

In order to make the objectives, technical solutions, and advantages of the present invention clearer, the embodiments of the present invention are described in further detail in the following with reference to the accompanying drawings.

Embodiment 1

Figure 1:
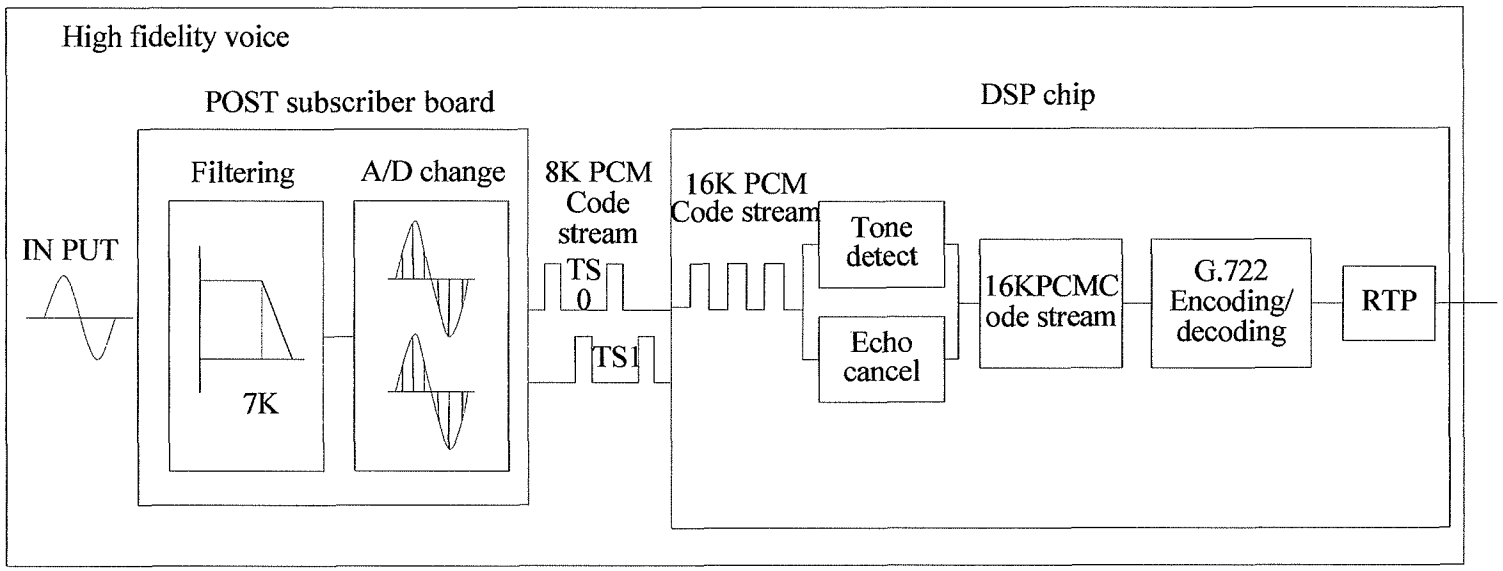
FIG. 1 is a schematic structural diagram of a principle of voice encoding/decoding in the prior art.
Figure 2:
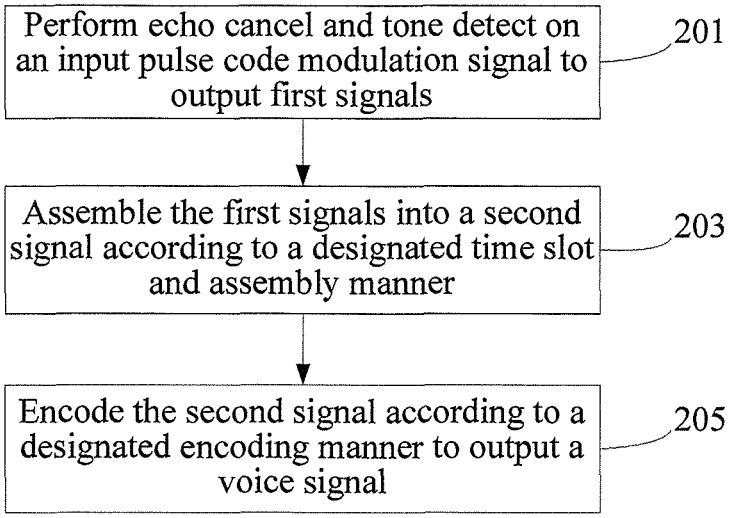
FIG. 2 is a flow chart of a voice encoding method according to a first embodiment of the present invention.

Referring to FIG. 2, this embodiment provides a voice encoding method. A specific procedure of the method is as follows.

Step 201: Perform echo cancel and tone detect on an input pulse code modulation (Pulse Code Modulation, PCM) signal to output first signals.

The first signals in this embodiment may be two 8-K pulse code modulation signals or four 8-K pulse code modulation signals.

Step 203: Assemble the first signals into a second signal according to a designated time slot and assembly manner.

In this embodiment, when the first signals are two 8-K pulse code modulation signals, the second signal may be a 16-K pulse code modulation signal. When the first signals are four 8-K pulse code modulation signals, the second signal may be a 32-K pulse code modulation signal.

Step 205: Encode the second signal according to a designated encoding manner to output a voice signal.

With the method provided in this embodiment, the pulse code modulation signal is assembled before encoding, and then an assembled signal is encoded to output a voice signal. Because a process of assembling the signal may be implemented through software, with the method provided in this embodiment, in the case that hardware in a current network does not need to be replaced, a function of encoding voice with a 7 K spectrum in the current network may also be implemented, thus improving voice quality and user experience, and furthermore, lowering a requirement imposed by the voice encoding on the hardware.

Embodiment 2

Figure 3:
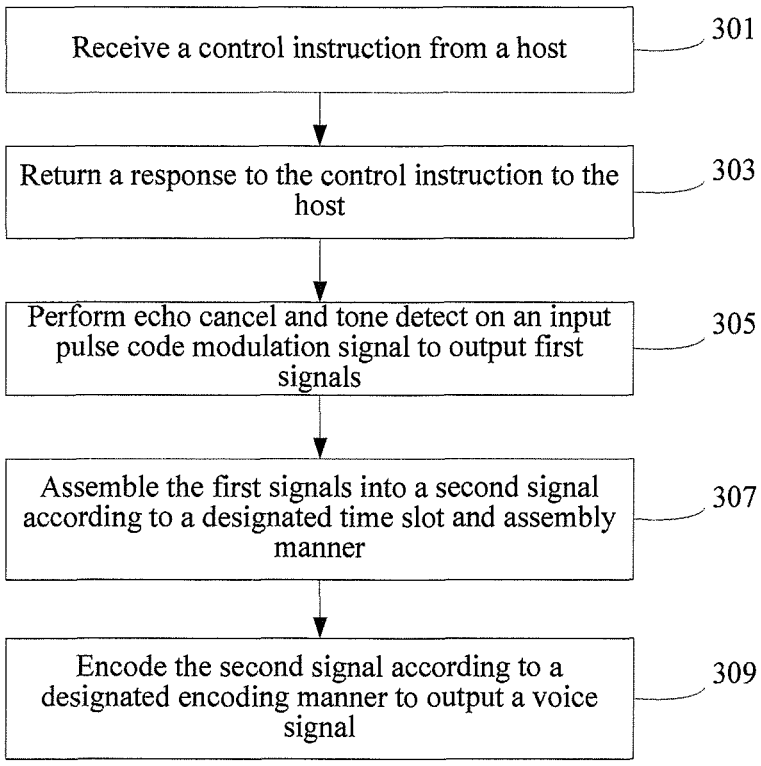
FIG. 3 is a flow chart of a voice encoding method according to a second embodiment of the present invention.

This embodiment provides a voice encoding method. To felicitate the description, in this embodiment, an available spectrum may be divided into two non-overlapping frequency bands including a first frequency band and a second frequency band. The first frequency band may be a spectrum which is 3.4 K or a spectrum which is lower than 3.4 K. The second frequency band may be a spectrum which is higher than 3.4 K (for example, a 7-K spectrum). In order to lower a requirement on hardware for implementing voice encoding in a current network, in the case that the hardware in the current network is not replaced, voice encoding in the second frequency band may be implemented in the current network. In this embodiment, an input pulse code modulation signal is assembled into a signal before encoding, so as to implement voice encoding. The method provided in this embodiment is described in detail in the following by taking implementation of voice encoding in the 7-K spectrum of the second frequency band as an example. As shown in FIG. 3, a specific procedure of the method includes:

Step 301: Receive a control instruction from a host.

The control instruction is used to designate a time slot, an assembly manner and an encoding manner.

Specifically, a control module of the host sends the control instruction. The control instruction may be in a form of a message defined in the host, and may also be in other forms. In this embodiment, a specific form of the control instruction is not limited.

The designated encoding manner may be G.711, G.722, G.729 or G.726, and the designated time slot refers to a time slot required to be occupied when a signal is input. For example, G.711 needs to occupy one time slot, and G.722 needs to occupy two or four time slots. In this embodiment, the designated time slot may include a first time slot TS0 and a second time slot TS1, where TS0 and TS1 are respectively corresponding to an 8-K pulse code modulation signal.

The designated assembly manner includes, but is not limited to, the following two types.

1. A head-tail connecting manner: The pulse code modulation signals corresponding to the designated time slots are connected head to tail.

In this embodiment, a tail portion of the 8-K pulse code modulation signal corresponding to the time slot TS0 is connected to a head portion of the 8-K pulse code modulation signal corresponding to the time slot TS1, and the pulse code modulation signal corresponding to the time slot TS0 is followed by the pulse code modulation signal corresponding to the time slot TS1.

2. An insertion manner: A pulse code modulation signal corresponding to a designated time slot is inserted in the middle of a pulse code modulation signal corresponding to another designated time slot.

In this embodiment, the pulse code modulation signal corresponding to the time slot TS1 is inserted in the middle of the pulse code modulation signal corresponding to the time slot TS0.

Step 303: Return a response to the control instruction to the host.

For this step, returning the response to the control instruction may be performed after the execution of the following steps, and may also be performed after receiving the control instruction. In this embodiment, when the response is returned is not specifically limited.

This step is optional. After the control instruction is received, the response to the control instruction may also not be returned.

Step 305: Perform echo cancel and tone detect on an input pulse code modulation signal to output first signals.

For example, the first signals in this embodiment are two 8-K pulse code modulation signals.

The echo cancel and tone detect are existing functions in the current network. During implementation of the voice encoding method provided in this embodiment, these two functions still need to be used.

Step 307: Assemble the first signals into a second signal according to the designated time slot and assembly manner.

Figure 4:
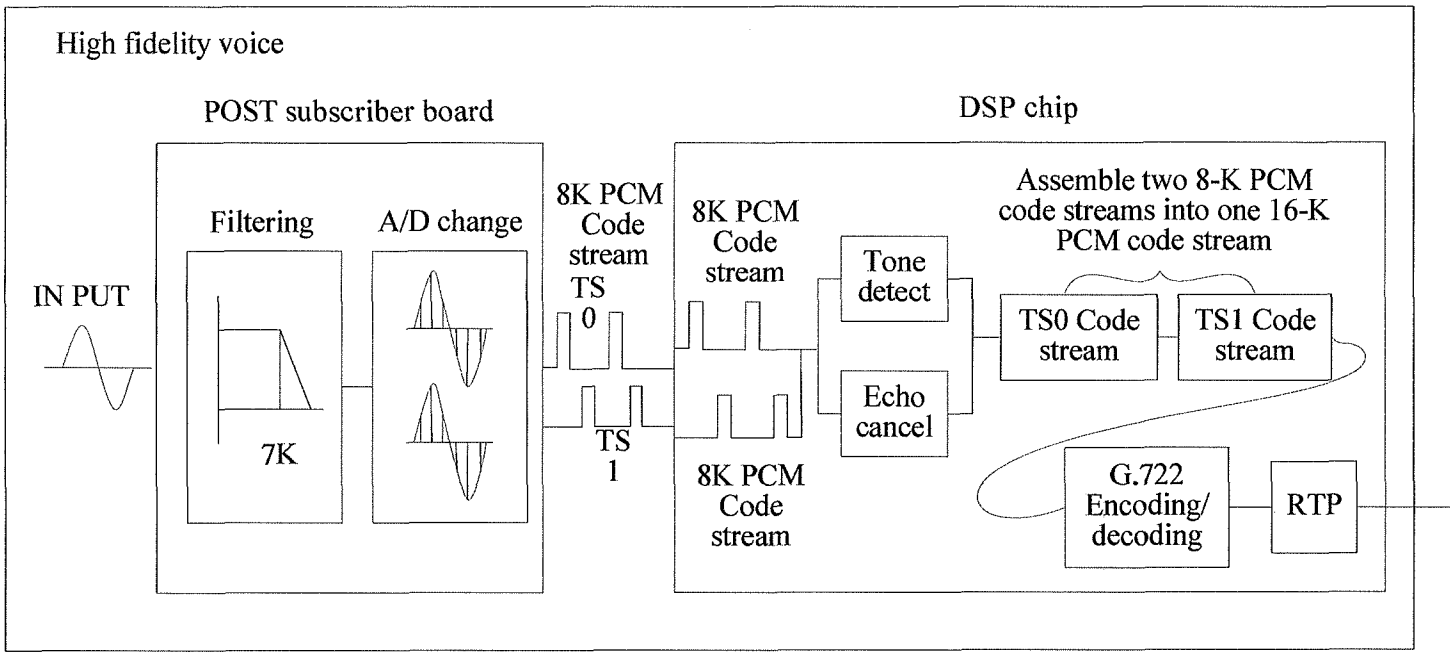
FIG. 4 is a schematic structural diagram of a principle of voice encoding according to the second embodiment of the present invention.

This step is a key to the method provided in this embodiment . The first signals may be stored in a buffer area. In order to implement voice encoding in a 7-K spectrum of the second frequency band, a sampling frequency is at least 16 KHZ. Therefore, two 8-K pulse code modulation signals need to be assembled into one 16-K signal, as shown in a schematic structural diagram of a principle of voice encoding in FIG. 4.

Specifically, when the first signals are assembled into the second signal according to the designated time slot and assembly manner: If the designated assembly manner is the head-tail connecting manner mentioned in step 301, for this step, the pulse code modulation signal corresponding to the first time slot and the pulse code modulation signal corresponding to the second time slot are connected head to tail, so that the pulse code modulation signals are assembled into one second signal. That is to say, the tail portion of the 8-K pulse code modulation signal corresponding to the time slot TS0 in the buffer is connected to the head portion of the 8-K pulse code modulation signal corresponding to the time slot TS1 in the buffer.

The pulse code modulation signal corresponding to the time slot TS0 is followed by the pulse code modulation signal corresponding to the time slot TS1, so that two pulse code modulation signals in the buffer are assembled into one second signal; and if the designated assembly manner is the insertion manner mentioned in step 301, for this step, the pulse code modulation signal corresponding to the second time slot needs to be inserted in the middle of the pulse code modulation signal corresponding to the first time slot, so that the pulse code modulation signals are assembled into one second signal. That is to say, the pulse code modulation signal corresponding to the time slot TS1 in the buffer is inserted in the middle of the pulse code modulation signal corresponding to the time slot TS0 in the buffer, so that the two pulse code modulation signals in the buffer are assembled into one second signal after the insertion.

Because a process of assembling two 8-K pulse code modulation signals into one 16-K signal may be implemented through software, through the technical solution provided in this embodiment, in the case that the hardware in the current network does not need to be upgraded, the voice encoding in the 7-K spectrum of the second frequency band may be implemented in the current network.

Furthermore, the first signals may also be four 8-K pulse code modulation signals, and the method provided in this embodiment is also applicable to the case that four 8-K pulse code modulation signals are input. That is, after four 8-K pulse code modulation signals that are performed echo cancel and tone detect are buffered, the four 8-K pulse code modulation signals are assembled into one 32-K signal for encoding processing. In this embodiment, the assembly manner is not limited, and reference may be made to the assembly manners mentioned in step 301, which is not described here again.

Step 309: Encode the second signal according to the designated encoding manner to output an encoded voice signal.

Since there are multiple encoding manners, in this embodiment, the designated encoding manner is not specifically limited.

It should be noted that, in this embodiment, although the implementation of voice encoding in the second frequency band is taken as an example to describe the voice encoding method provided in this embodiment, the voice encoding method provided in this embodiment is also applicable to voice encoding in the first frequency band. For the voice encoding in the first frequency band, the encoding manner designated in this step should be applicable to an encoding manner of the first frequency band, for example, G.711.

In conclusion, with the method provided in this embodiment, the buffered pulse code modulation signals are assembled before encoding, and then an assembled signal is encoded to output a voice signal. Since the process of assembling the signal may be implemented through the software, with the method provided this embodiment, in the case that the hardware in the current network does not need to be replaced, voice encoding in both the first frequency band and the second frequency band may also be implemented in the current network, thus improving voice quality in the current network and user experience, and furthermore, lowering the requirement imposed by the voice encoding on the hardware.

Embodiment 3

Figure 5:
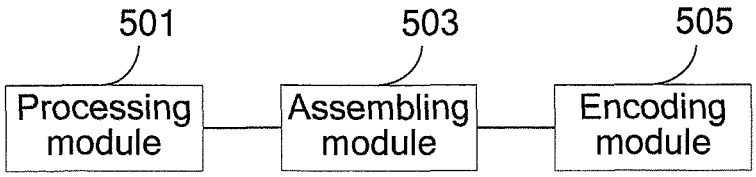
FIG. 5 is a schematic structural diagram of a first communication device according to a third embodiment of the present invention.

Referring to FIG. 5, this embodiment provides a communication device. The device includes:

- a processing module 501, configured to perform echo cancel and tone detect on an input pulse code modulation signal to output first signals, where, in this embodiment, the first signals may be two 8-K pulse code modulation signals;
- an assembling module 503, configured to assemble the first signals into a second signal according to a designated time slot and assembly manner; and
- an encoding module 505, configured to encode the second signal according to a designated encoding manner to output a voice signal.

Figure 6:
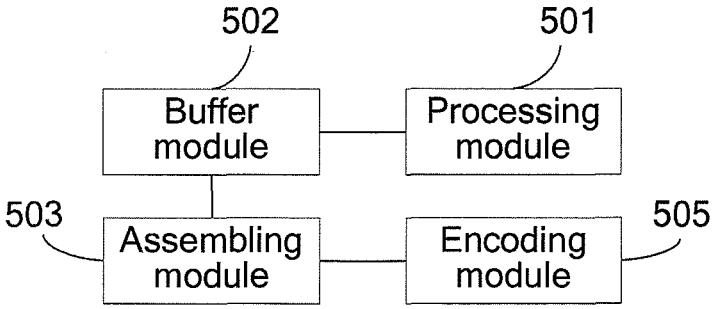
FIG. 6 is a schematic structural diagram of a second communication device according to the third embodiment of the present invention.

Referring to FIG. 6, the device provided in this embodiment may further include a buffer module 502, configured to store the first signals.

It should be noted that, the communication device provided in this embodiment is not only applicable to voice with a 7 K spectrum, but also applicable to voice with a 3.4 K spectrum. For voice with different spectrums, only a corresponding encoding manner needs to be designated. For example, when the voice with the 7 K spectrum is encoded, the designated encoding manner is G.722. When the voice with the 3.4 K spectrum is encoded, the designated encoding manner is G.711.

Figure 7:
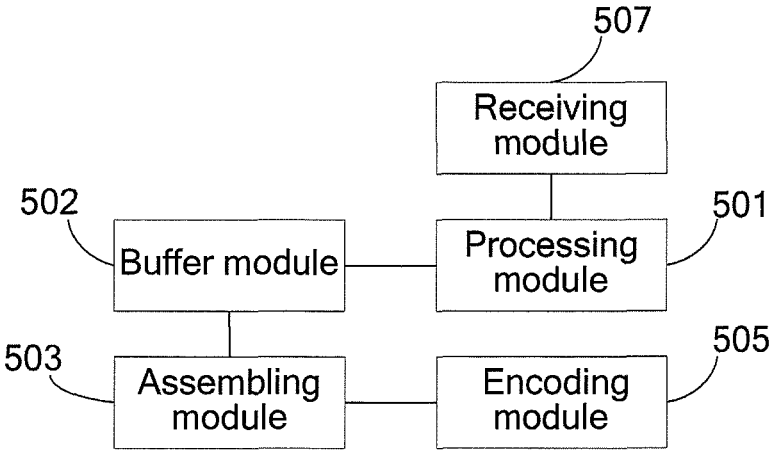
FIG. 7 is a schematic structural diagram of a third communication device according to the third embodiment of the present invention.

Furthermore, referring to FIG. 7, the device may further include:

a receiving module 507, configured to receive a control instruction sent by a host, where the control instruction is used to designate a time slot, an assembly manner and an encoding manner.

In this embodiment, the control instruction includes a first time slot and a second time slot, and the first time slot and the second time slot are respectively corresponding to an 8-K pulse code modulation signal.

Figure 8:
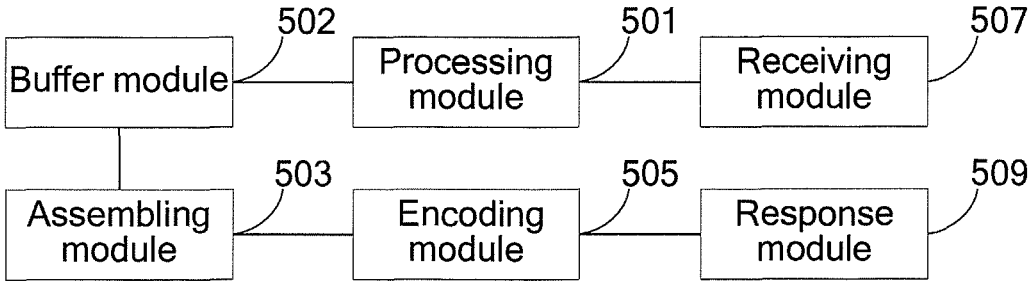
FIG. 8 is a schematic structural diagram of a fourth communication device according to the third embodiment of the present invention.

Referring to FIG. 8, the device may further include;

a response module 509, configured to return a response to the control instruction to the host.

The control instruction received by the receiving module 507 is sent by a control module of the host. The response module 509 may return the response immediately after the receiving module 507 receives the control instruction, and may also return the response after the encoding is completed. Returning the response after encoding is taken as an example, as shown in FIG. 8. An interaction between the control module of the host and the voice encoding device may be implemented through an internal interface function or through an upper-layer protocol with a certain format, maybe completed through an internal communication primitive or through a plurality of primitives, and may be applied across modules or within one module, which are not specifically limited in this embodiment.

Specifically, the assembling module 503 includes a connection unit and an insertion unit.

The connection unit is configured to connect the pulse code modulation signal corresponding to the first time slot to the pulse code modulation signal corresponding to the second time slot head to tail to assemble the pulse code modulation signals into one second signal.

The insertion unit is configured to insert the pulse code modulation signal corresponding to the second time slot into the middle of the pulse code modulation signal corresponding to the first time slot to assemble the pulse code modulation signals into one second signal.

In conclusion, with the communication device provided in this embodiment, the buffered pulse code modulation signals are assembled before encoding, and then an assembled signal is encoded to output a voice signal. Because a process of assembling the signal may be implemented through software, in the case that hardware in a current network does not need to be replaced, the voice encoding in both the 3.4-K spectrum and 7-K spectrum may be implemented in the current network, thus improving voice quality and user experience, and furthermore, lowering a requirement imposed by the voice encoding on the hardware.

Embodiment 4

Figure 9:
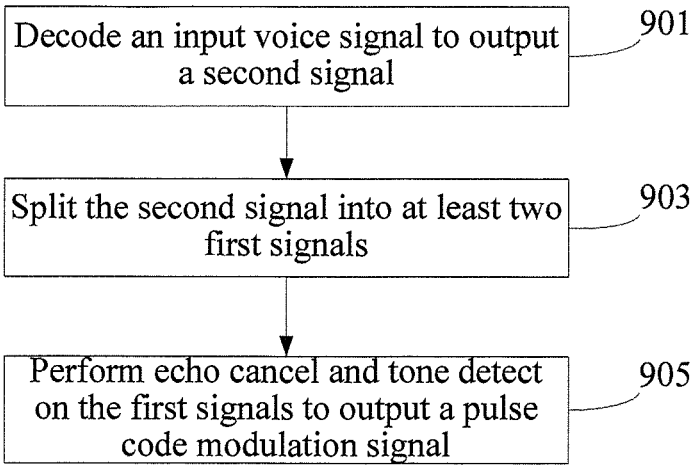
FIG. 9 is a flow chart of a voice decoding method according to a fourth embodiment of the present invention.

Referring to FIG. 9, this embodiment provides a voice decoding method. A specific procedure of the method is as follows.

Step 901: Decode an input voice signal to output a second signal.

The second signal in this embodiment may be one 16-K pulse code modulation signal or one 32-K pulse code modulation signal.

Specifically, when the input voice signal is decoded, the input voice signal is decoded according to an encoding manner of the input voice signal. For example, if the input voice signal adopts an encoding manner that is based on G.711, the input voice signal is decoded in a decoding manner that is still based on G.711.

Step 903: Split the second signal into at least two first signals.

The second signal may be stored in a buffer area. The first signals maybe formed by at least two pulse code modulation signals. The following manners may be used to split the second signal.

An average split manner: The second signal is averagely split into a plurality of pulse code modulation signals. Taking that the second signal is a 16-K pulse code modulation signal as an example, that is, a previous 8 K of the 16-K pulse code modulation signal is split as one pulse code modulation signal, and a last 8 K of the 16-K pulse code modulation signal is split as one pulse code modulation signal. That is, one 16-K second signal is averagely split into two 8-K pulse code modulation signals.

A middle extraction manner: The second signal is split into a plurality of pulse code modulation signals in the middle extraction manner. Taking that the second signal is a 16-K pulse code modulation signal as an example, a previous 4 K and a last 4 K of the second signal are formed into one pulse code modulation signal, and a middle 8 K of the second signal is formed into one pulse code modulation signal.

In this embodiment, a specific split manner of the second signal is not limited.

Step 905: Perform echo cancel and tone detect on the first signals to output a pulse code modulation signal.

With the method provided in this embodiment, when a voice signal is input, the voice signal is decoded to obtain a pulse code modulation signal, and after the pulse code modulation signal obtained through decoding is buffered, the pulse code modulation is split to output a pulse code modulation signal. Because splitting the pulse code modulation signal may be implemented through software, with the voice decoding method provided in this embodiment, in the case that hardware in a current network does not need to be replaced, a function of decoding voice with a 7 K spectrum may be implemented in the current network, thus improving voice quality and user experience, and furthermore, lowering a requirement imposed by voice decoding in the current network on the hardware.

Embodiment 5

Figure 10:
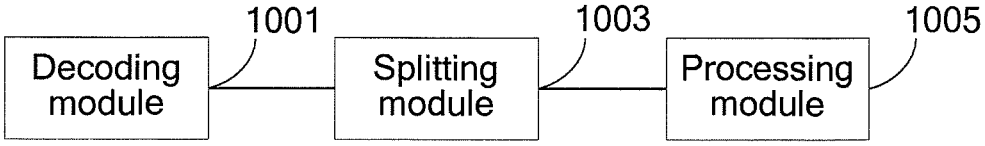
FIG. 10 is a schematic structural diagram of a communication device according to a fifth embodiment of the present invention.

Referring to FIG. 10, this embodiment provides a communication device. The device includes:

a decoding module 1001, configured to decode an input voice signal to output a second signal, where the second signal in this embodiment may be a 16-K pulse code modulation signal or a 32-K pulse code modulation signal;

a splitting module 1003, configured to split the second signal to output first signals, where in this embodiment, when the second signal is a 16-K pulse code modulation signal, the first signals may be two 8-K pulse code modulation signals, and when the second signal is a 32-K pulse code modulation signal, the first signals maybe four 8-K pulse code modulation signals; and a processing module 1005, configured to perform echo cancel and tone detect on the first signals to output a pulse code modulation signal.

Figure 11:
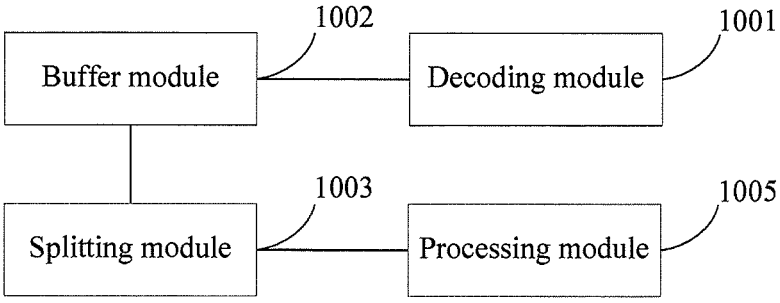
FIG. 11 is a schematic structural diagram of another communication device according to the fifth embodiment of the present invention.

Referring to FIG. 11, the device provided in this embodiment may further include a buffer module 1002, configured to store the second signal.

The splitting module 1003 specifically includes an average split unit and a middle extraction unit.

The average split unit is configured to averagely split the second signal into a plurality of pulse code modulation signals.

Taking that the second signal is the 16-K pulse code modulation signal as an example, the average split unit splits a previous 8 K of the 16-K pulse code modulation signal as one pulse code modulation signal, and splits a last 8 K of the 16-K pulse code modulation signal as one pulse code modulation signal.

The middle extraction unit is configured to extract a pulse code modulation signal in the middle of the second signal so as to split the second signal into the pulse code modulation signals.

In conclusion, with the communication device provided in this embodiment, when a voice signal is input, the voice signal is decoded to obtain a pulse code modulation signal, and after the pulse code modulation signal obtained through decoding is buffered, the pulse code modulation signal is split to output a pulse code modulation signal. A function of decoding voice with a 7 K spectrum may be implemented in a current network without replacing hardware in the current network, thus improving voice quality and user experience, and furthermore, lowering a requirement imposed by voice decoding on the hardware.

Embodiment 6

This embodiment provides a communication system. The provided communication system includes a communication device, as shown in FIG. 5. The communication device includes:

a processing module 501, configured to perform echo cancel and tone detect on an input pulse code modulation signal to output first signals, where in this embodiment, the first signals may be two 8-K pulse code modulation signals;

an assembling module 503, configured to assemble the first signals into a second signal according to a designated time slot and assembly manner; and an encoding module 505, configured to encode the second signal according to a designated encoding manner to output a voice signal.

This embodiment further provides a communication system, which includes a communication device, as shown in FIG. 10. The communication device includes:

a decoding module 1001, configured to decode an input voice signal to obtain a second signal;

a splitting module 1003, configured to split the second signal into at least two first signals; and a processing module 1005, configured to perform echo cancel and tone detect on the first signals to output a pulse code modulation signal.

With the communication system provided in this embodiment, when a voice signal is input, the voice signal is decoded to obtain a pulse code modulation signal. The pulse code modulation signal obtained through decoding is split to output a pulse code modulation signal. A function of decoding voice with a 7 K spectrum may be implemented in a current network without replacing hardware in the current network, thus improving voice quality and user experience, and furthermore, lowering a requirement imposed by voice decoding on the hardware.

It should be noted that, each functional module in the voice encoding device provided in Embodiment 3 and each functional module in the communication device provided in Embodiment 5 may be combined in one device. The technical solutions provided in the embodiments of the present invention may be not only applicable to a current encoding/decoding technology, but also applicable to an encoding/decoding technology that is implemented through up sampling/down sampling of an 8 K signal, for example, encoding/decoding technologies such as 24-K sampling and 32-K sampling.

Sequence numbers of the preceding embodiments of the present invention are merely used for description, and do not represent a preferential order of the embodiments.

A part of the steps of the method in the embodiments of the present invention may be implemented through software, and a corresponding software program may be stored in a readable storage medium, such as an optical disk or a hard disk.

The preceding descriptions are merely exemplary embodiments of the present invention, but are not intended to limit the present invention. Any modification, equivalent replacement, or improvement made without departing from the spirit and principle of the present invention shall fall within the protection scope of the present invention.

What is claimed is:

1. A voice encoding method, comprising:

performing echo cancel and tone detect on an input pulse code modulation signal to output first signals;

assembling the first signals into a second signal according to a designated time slot and assembly manner; and encoding the second signal according to a designated encoding manner to output a voice signal;

wherein the first signals are two 8-K Pulse Code Modulation (PCM) signals and the second signal is a 16-K PCM signal; or wherein the first signals are four 8-K Pulse Code Modulation (PCM) signals and the second signal is a 32-K PCM signal;

wherein the designated time slot comprises a first time slot and a second time slot, and assembling the first signals into the second signal according to the designated time slot and assembly manner comprises:

inserting a pulse code modulation signal corresponding to the second time slot into the middle of a pulse code modulation signal corresponding to the first time slot to assemble the pulse code modulation signals into the second signal.

2. A communication device, comprising a processor, wherein the processor is configured to:

perform echo cancel and tone detect on an input pulse code modulation signal to output first signals;

assemble the first signals into a second signal according to a designated time slot and assembly manner; and encode the second signal according to a designated encoding manner to output a voice signal;

wherein the first signals are two 8-K Pulse Code Modulation (PCM) signals and the second signal is a 16-K PCM signal; or wherein the first signals are four 8-K Pulse Code Modulation (PCM) signals and the second signal is a 32-K PCM signal;

wherein the designated time slot comprises a first time slot and a second time slot, and the processor is further configured to:

connect a pulse code modulation signal corresponding to the first time slot to a pulse code modulation signal corresponding to the second time slot head to tail; and insert the pulse code modulation signal corresponding to the second time slot into the middle of the pulse code modulation signal corresponding to the first time slot.

3. A communication system, comprising: a first communication device and a second communication device; wherein, the first communication device is configured to perform echo cancel and tone detect on an input pulse code modulation signal to output first signals; assemble the first signals into a second signal according to a designated time slot and assembly manner; encode the second signal according to a designated encoding manner to output a voice signal; and send the voice signal to the second communication device;

wherein the first signals are two 8-K Pulse Code Modulation (PCM) signals and the second signal is a 16-K PCM signal; or wherein the first signals are four 8-K Pulse Code Modulation (PCM) signals and the second signal is a 32-K PCM signal;

wherein the designated time slot comprises a first time slot and a second time slot, and the processor is further configured to:

connect a pulse code modulation signal corresponding to the first time slot to a pulse code modulation signal corresponding to the second time slot head to tail; and insert the pulse code modulation signal corresponding to the second time slot into the middle of the pulse code modulation signal corresponding to the first time slot.

4. The system according to claim 3, wherein the second communication device is configured to:

receive the voice signal;

decode the voice signal to obtain the second signal;

split the second signal into at least two first signals; and perform echo cancel and tone detect on the at least two first signals to output a PCM signal.

* * * * *